US006513187B1

(12) United States Patent
Naseth, Sr.

(10) Patent No.: US 6,513,187 B1
(45) Date of Patent: Feb. 4, 2003

(54) CONTINUOUS CARPET CLEANING SYSTEM

(76) Inventor: Donald P. Naseth, Sr., 15857 - 34th NE., Seattle, WA (US) 98155

( * ) Notice: Subject to any disclaimer, the term of this patent is extended or adjusted under 35 U.S.C. 154(b) by 0 days.

(21) Appl. No.: 09/689,014

(22) Filed: Oct. 12, 2000

(51) Int. Cl.[7] ..... A47L 5/38

(52) U.S. Cl. ..... 15/314; 15/302; 15/319; 15/339; 137/205; 137/208

(58) Field of Search ..... 15/302, 314, 320, 15/321, 339, 319; 137/205, 208

(56) References Cited

U.S. PATENT DOCUMENTS

| | | | | | |
|---|---|---|---|---|---|
| 2,810,991 | A | * | 10/1957 | Mead et al. | 15/321 |
| 2,832,370 | A | | 4/1958 | Hill | 137/391 |
| 4,080,104 | A | | 3/1978 | Brown, Jr. | 417/17 |
| 4,202,072 | A | * | 5/1980 | Gonzales | 15/302 |
| 4,293,300 | A | * | 10/1981 | Cattani | 137/205 |
| 4,378,611 | A | | 4/1983 | Ninehouser | 15/353 |
| 4,723,337 | A | | 2/1988 | Ellison et al. | 15/300 |
| 4,800,612 | A | | 1/1989 | Valentine | 15/314 |
| 4,823,428 | A | | 4/1989 | Sevigny | 15/302 |
| 5,022,114 | A | * | 6/1991 | Kauffeldt et al. | 137/205 |
| 5,907,879 | A | | 6/1999 | Downey | 8/158 |
| 5,920,955 | A | * | 7/1999 | Berfield | 15/321 |
| 5,985,009 | A | | 11/1999 | Marsala | 96/250 |
| 6,009,892 | A | * | 1/2000 | Martinitz | 137/1 |

* cited by examiner

*Primary Examiner*—Theresa T. Snider
(74) *Attorney, Agent, or Firm*—Dean A. Craine

(57) ABSTRACT

A carpet cleaning system that delivers heated cleaning water from a truck to a carpet cleaning apparatus and an improved waste disposal tank designed to receive the waste water and deposit it into the toilet or sewer drain when the disposal tank is full. The disposal tank is divided into an upper primary recovery tank and a lower recovery tank. A main vacuum line and waste water return line are connected to the primary recovery tank. Disposed between the primary and secondary recovery tanks is a first check valve that controls the flow of waste water therebetween. Connected over the outlet port on the secondary recovery tank is a second check valve that operates in opposite direction to the first check valve. Attached to the secondary recovery tank is an air control valve that controls the flow of air from the primary recovery tank or the outside air into the secondary recovery tank. A timer or a float valve is connected to the air control valve to selectively control its operation. When the air control valve is inactivated, the air pressures in the tanks are equal and sub-atmospheric. When the air control valve is activated, the flow of air between the tanks is discontinued and outside air is able to flow into the secondary recovery tank. When outside air enters the secondary recovery tank, the first check valve closes to maintain vacuum pressure inside the primary recovery tank for cleaning, and the second check valve opens to allow discharge of the waste water from the secondary recovery tank.

4 Claims, 5 Drawing Sheets

CONTINUOUS CARPET CLEANING SYSTEM

BACKGROUND OF THE INVENTION

1. Field of the Invention

This invention pertains to a waste liquid disposal system and, more particularly, to such a system for cleaning carpets.

2. Description of the Related Art

Carpet cleaners that spray a detergent solution into a rug and then vacuum the dirty water out of the rug are widely used by small businesses and homeowners. The dirty water removed from the carpet contains harmful chemicals and cannot be deposited in storm drains. Instead, this dirty water must be deposited in sewer lines that eventually lead to a sewer treatment plant. Because many homes and businesses are connected to sewer lines, users often deposit the waste water directly in their toilets.

Most mug cleaners include a holding tank in which the waste water is temporarily deposited. Some cleaners, such as the one disclosed in U.S. Pat. No. 4,823,428, include sensing switches located inside the holding tank that detect when the waste water inside the holding tank is at a specific level. When the waste water reaches a specific level, it is then automatically discarded by gravity through a lower opening in the holding tank into a toilet or sewer line.

One problem with using sensing switches located inside the holding tank is that they often fail to operate when clogged or corroded. Another problem is that when the waste water is discarded from the holding tank, the vacuum pressure is temporarily lost thereby discontinuing removal of waste water from the carpet.

What is needed is an improved carpet cleaning system that automatically and continuously discards the waste water into a toilet or sewer drain without discontinuing the vacuum pressure to the cleaning apparatus.

SUMMARY OF THE INVENTION

It is an object of the present invention to provide a continuous carpet cleaning system that automatically discards collected waste water into a toilet or sewer line. It is believed that such a system that uses in combination two recovery tanks, two opposite oriented check valves, an air control valve, and a control means to control the air control valve is not anticipated, nor rendered obvious, suggested, or even implied by any prior art carpet cleaning apparatus, either alone or in any combination thereof.

The carpet cleaning system disclosed herein uses heated cleaning water pumped from a truck to a carpet cleaning apparatus via a water delivery hose. A main vacuum hose runs from the truck to an improved waste water disposal tank located directly over a toilet connected to a sewer drain or located directly over a sewer drain. A second vacuum hose connects the carpet cleaning apparatus to the disposal tank to deliver waste water from the carpet cleaning apparatus to the disposal tank. The disposal tank is designed to continuously collect waste water from the carpet cleaning apparatus and to automatically discard the waste water into the toilet or sewer drain at pre-selected time intervals or when the waste water reaches a specified level inside the disposal tank.

The disposal tank is divided into an upper primary recovery tank and a lower secondary recovery tank. Located in the primary recovery tank are a main vacuum exhaust port and a waste water inlet port. The main vacuum exhaust port connects to one end of the main vacuum hose that connects at its opposite end to a vacuum source. The waste water inlet port connects to one end of a second vacuum hose that connects at its opposite end to the carpet cleaning apparatus. When vacuum pressure is created in the primary and secondary recovery tanks, it is automatically created in the secondary vacuum hose and delivered to the carpet cleaning apparatus.

In order to automatically discard waste water from the disposal tank and continuously provide adequate vacuum pressure to the carpet cleaning apparatus, a novel combination of stacked recovery tanks, two opposite oriented valves, an air control valve, and control means are used. More specifically, disposed between the primary recovery tank and the secondary recovery tank is a first check valve. The first check valve is oriented so that it is open when equal vacuum pressure is created in the primary and secondary recovery tanks, when waste water is delivered to the primary recovery tank, it automatically drains into the secondary recover tank. Formed on the secondary recovery tank is a second check valve. The second check valve is oriented in the opposite direction as the first check valve so that it is closed when air pressure inside the secondary recovery tank is sub-atmospheric. When the first check valve closes, the second check valve opens, and vise versa.

Disposed between the primary recovery tank and the secondary recovery tank is an air conduit connected to a secondary valve port on the air control valve. The air control valve includes two valve ports with one valve port connected to the sides of the secondary recovery tank and the other valve port connected to the air conduit. The air control valve also includes an outside air port exposed to the atmosphere. During use, the air control valve controls the flow of air into the primary recovery tank from the secondary recovery tank or from the atmosphere. When the components of the system are properly connected together and the vacuum source is initially activated, the outside inlet port on the air control valve is closed so that vacuum pressure in the primary and secondary recovery tanks are equal which, in turn, causes the first check valve to automatically open. Since the pressure inside the secondary recovery tank is below atmospheric pressure, the second check valve automatically closes thereby allowing waste water to accumulate inside the secondary recovery tank.

When the air control valve is activated, the outside inlet port opens thereby enabling outside air to enter the secondary recovery tank and close the first check valve. When the air pressure inside the secondary recovery tank equals or exceeds atmospheric pressure, the second check valve opens and discharges the waste water from the secondary recovery tank. When the air control valve is deactivated, the outside inlet port closes so that the pressures inside the primary and secondary recovery tanks return to their initial state.

In the preferred embodiment, the air control valve is an electric solenoid valve connected to a control means to prevent overfilling of the secondary recovery tank. In the preferred embodiment, the control means is a timer designed to continuously open and close the solenoid valve at regular, pre-selected intervals. In a second embodiment, the timer is replaced with float switches located inside the secondary recovery tanks that automatically control the ports on the air control valves when the waste water reaches a specific level inside the secondary recovery tank. An optional control means is also provided inside the primary recovery tank to prevent overfilling of the primary recovery tank when the first check valve closes.

In another embodiment using a mobile system, a basin is provided under the secondary recovery tank to temporarily collect the discharged waste water from the secondary recovery tank. A pumping means and hose may be attached to the basin so that the discharged waste water may be transferred to a remote location.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DESCRIPTION OF THE PREFERRED EMBODIMENT(S)

Figure 1:
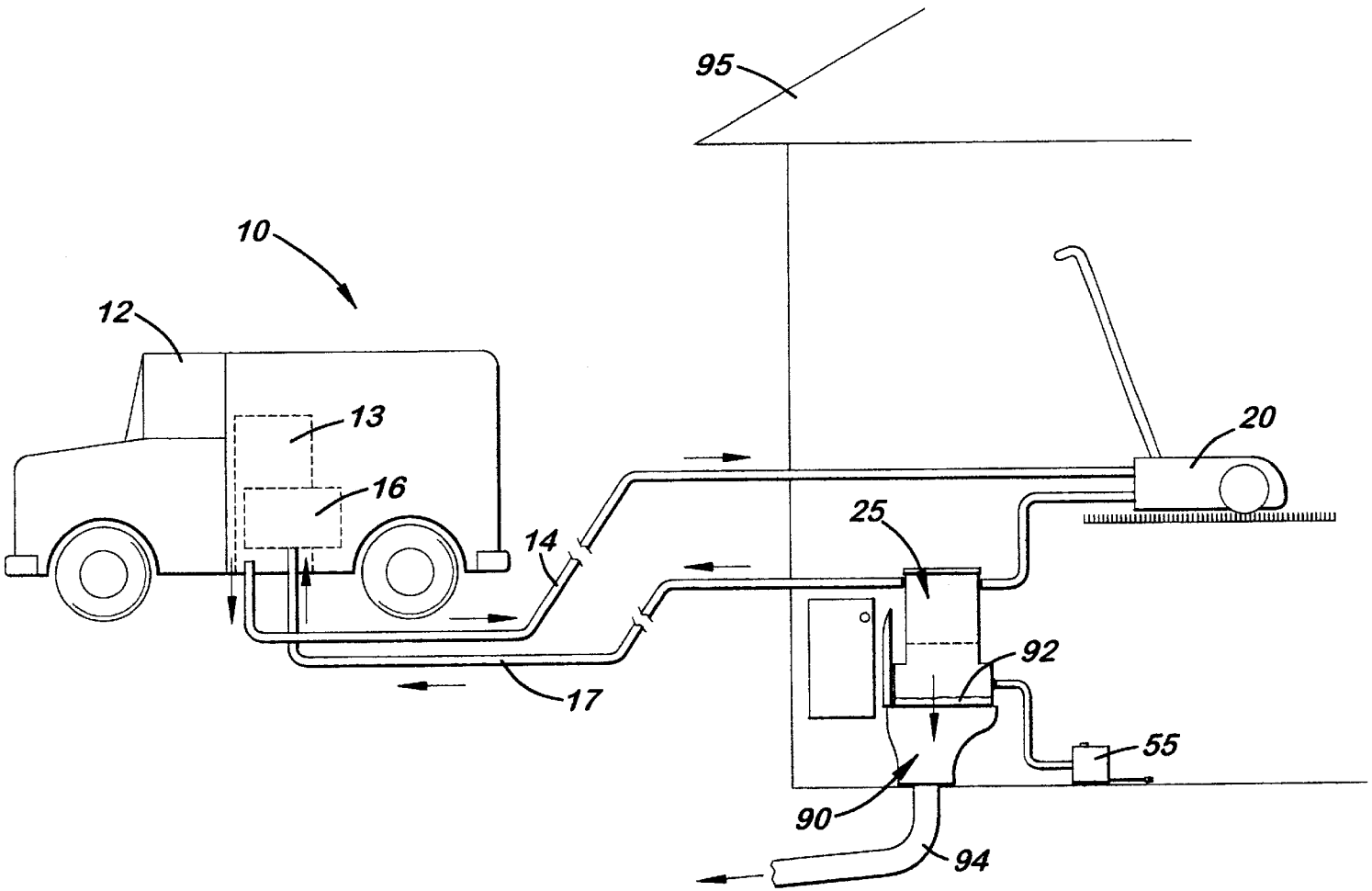
FIG. 1 is a schematic view of the carpet cleaning system disclosed herein.

Referring to the FIG. 1, there is shown and described a carpet cleaning system, generally referenced as 10, that first delivers cleaning water from a water tank 13 located in a truck 12 via a water line 14 connected to a carpet cleaning apparatus 20 located in a home or business 95. Using vacuum pressure created by a vacuum source 16 located in the truck 12, waste water 92 from the carpet is removed by the cleaning apparatus 20 and delivered to an improved waste disposal tank 25 designed to continuously receive the waste water 92 and automatically discard it into a toilet 90 or a sewer line 94.

Figure 2:
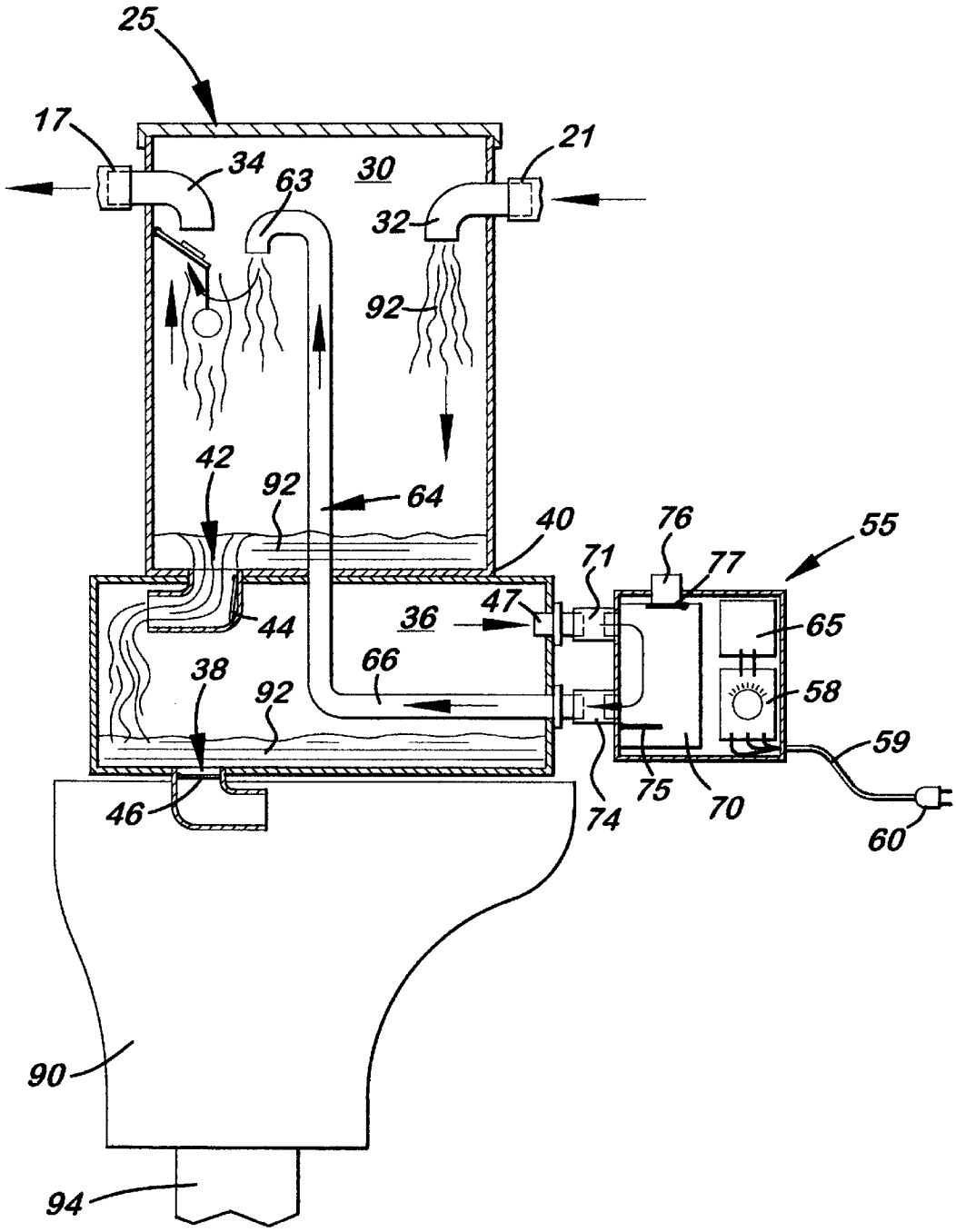
FIG. 2 is a side elevational view of the disposal tank with the solenoid valve closed thereby allowing waste water to accumulate in the secondary recovery tank.
Figure 3:
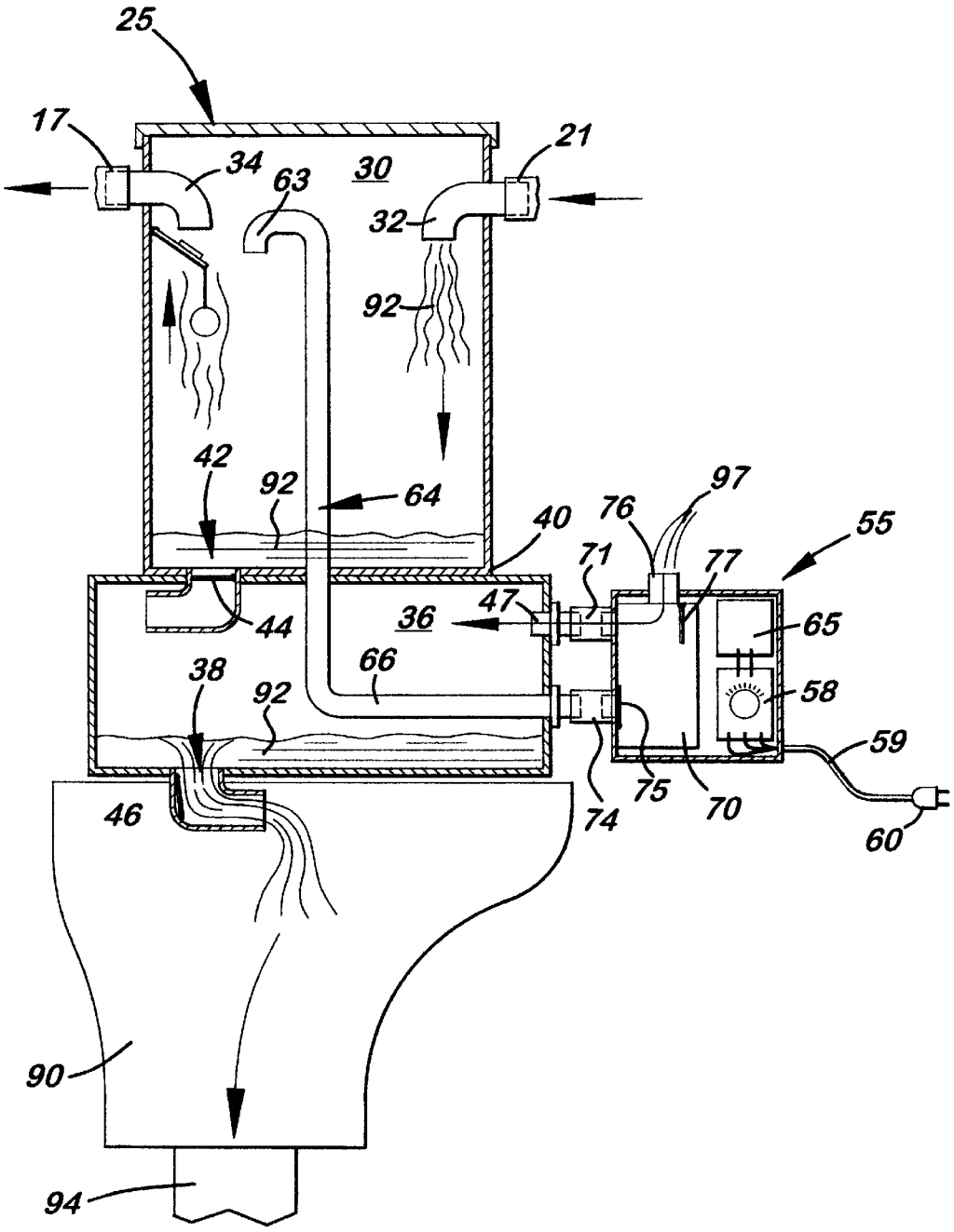
FIG. 3 is a side elevational view of the disposal tank with the solenoid valve opened thereby allowing waste water in the secondary recovery tank to be discharged and new waste water to accumulate inside the primary recovery tank.
Figure 4:
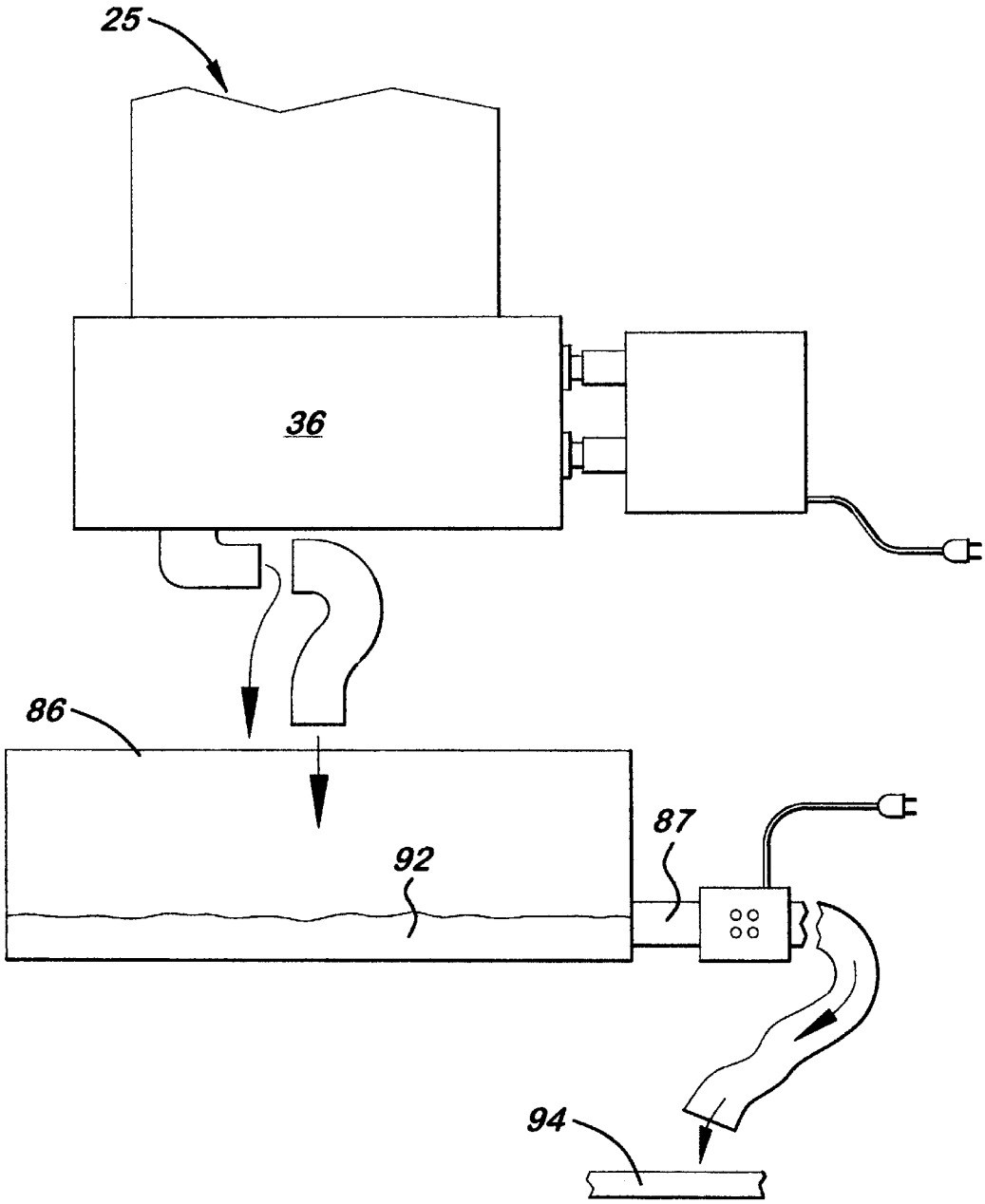
FIG. 4 is a side elevational view of the basin, pump and hose for transferring the waste water from the secondary tank to a remote location.

As shown in FIGS. 2–4, the disposal tank 25 is a closed structure which is divided into an upper primary recovery tank 30 and a lower secondary recovery tank 36. The primary recovery tank 30 includes a waste water inlet port 32 that connects to a second vacuum hose 21 connected at one end to the carpet cleaning apparatus 20. Also formed on the primary recovery tank 30 is an exhaust air outlet port 34 that connects to one end of a main vacuum hose 17. The opposite end of the main vacuum hose 17 is connected to the vacuum source 16 located in the truck 12.

The secondary recovery tank 36 is located directly below the primary recovery tank 30 with a separating partition generally referenced as 40 formed therebetween. A common port opening 42 is formed on the partition 40. A first check valve 44 is disposed over the port opening 42 to control the flow of air and waste water 92 between the two tanks 30, 36. When the pressures inside the two tanks 30, 36 are equal, the first check valve 44 is opened.

Formed on the bottom surface of the secondary recovery tank 36 is a waste water exit port opening 38 over which a second check valve 46 is placed. The second check valve 46 is oriented under the exit port opening 38 so that it operates in the opposite direction as the first check valve 44 and is used to control the flow of waste water 92 from the secondary recovery tank 36 to the sewer line 94. When the pressures inside the two tanks 30, 36 are equal, the second check valve 46 is closed.

Formed on the side of the secondary recovery tank 36 is a dual direction port connector 47 that connects to a first valve port 71 on an air control valve 70 discussed further below. The dual direction port connector 47 acts as an ingress and egress airway to the secondary recovery tank 36.

Disposed longitudinally and extending between the primary recovery tank 30 and the secondary recovery tank 36 is an air conduit 64. In the preferred embodiment, the upper end 63 of the air conduit 64 is located near the exhaust air outlet port 34. The air conduit 64 extends downward through the partition 40 and into the secondary recovery tank 36, and then bends laterally so that its lower section 66 terminates outside the secondary recovery tank 36.

Connected to the distal end of the lower section 66 of the air conduit 64 is the second valve port 74 on the air control valve 70. Disposed over the second valve port 74 is a pivoting control flap 75 that selectively opens or closes the port opening. The air control valve 70 also includes an outside air valve port 76 that connects to atmospheric air 97 Disposed over the outside air valve port 76 is a pivoting control flap 77 used to selectively open and close the outside air valve port 76. During use, the air control valve 70 controls the flow of air between the primary recovery tank 30, the secondary recovery tank 36, and the outside atmospheric air 97. In the preferred embodiment, the air control valve 70 is an electric solenoid type valve disposed inside a separate box 55. It should be understood that the solenoid type valve could be disposed inside the disposal tank 25.

The air control valve 70 is controlled by a separate control means. In the first embodiment, the control means is a timer 58 that selectively opens and closes the solenoid, valve at pre-selected intervals. In the preferred embodiment, the timer 58 is electric and connects to a 110 volt A.C. electric current via a power cord 59 and plug 60. The solenoid valve is also electric and operates on a 12 volt D.C. current that connects to a transformer 65 also electrically connected to the timer 58.

Figure 5:
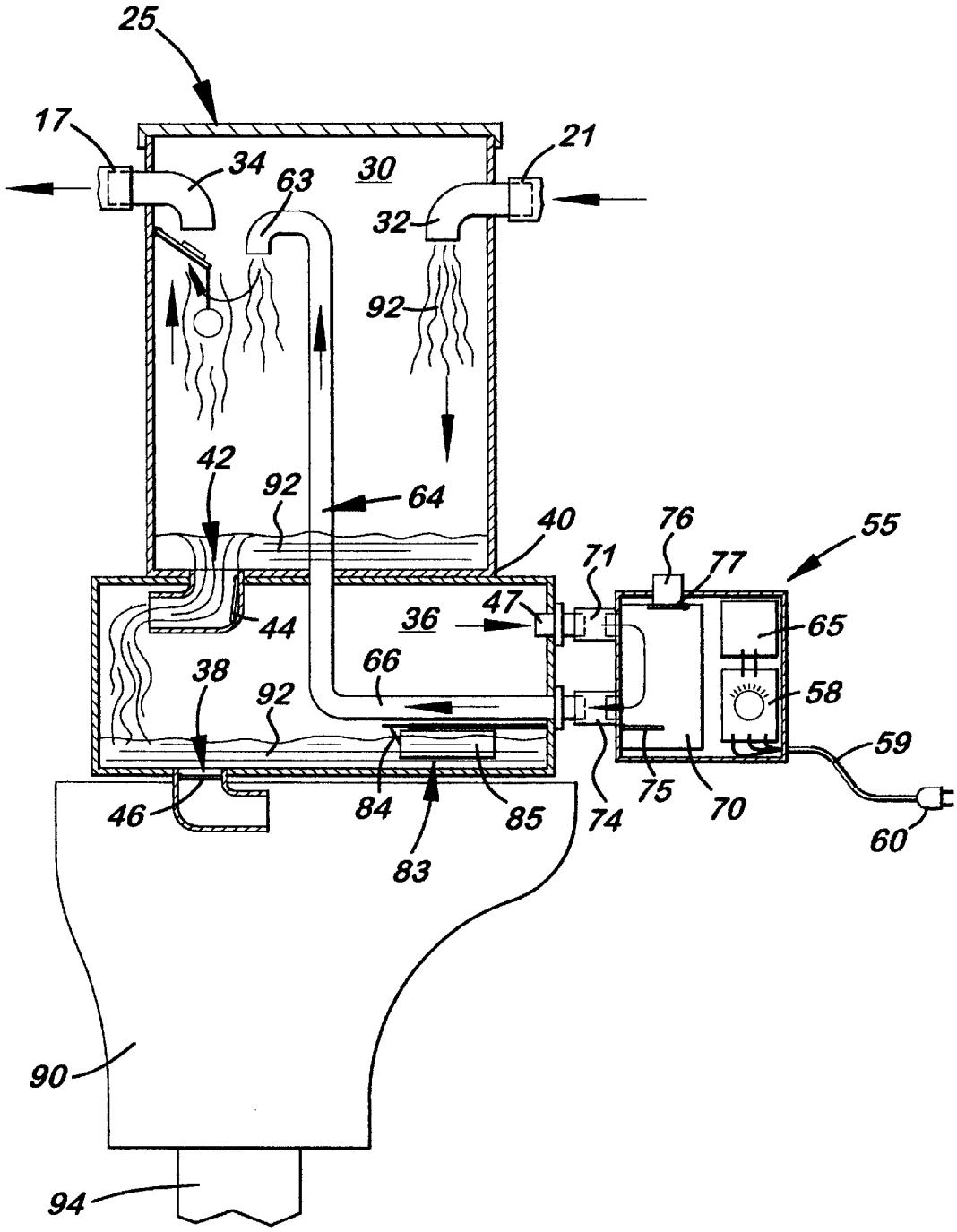
FIG. 5 is a schematic of the float switch used in place of the timer.

During use, the system 10 is set up as depicted in FIG. 1 and 2 with the control flap 77 closed and the control flap 75 open to create a closed circuit between the vacuum source 16, the primary and secondary recovery tanks 30, 36, respectively, and the cleaning apparatus 20, as shown in FIGS. 2 and 5. The timer 58 is connected to the air control valve 70 so that it opens at desired intervals according to the capacities of the vacuum source 16 and the primary and secondary recovery tanks 30, 36, respectively. When the vacuum source 16 is initially activated, the air pressures inside the two recovery tanks 30, 36 are equal and the first check valve 44 is open. As waste water 92 is then removed from the carpet and delivered to the primary recovery tank 30, the waste water 92 automatically drains into the secondary recovery tank 36.

During this initial stage, vacuum pressure is created in both the primary and secondary recovery tanks 30, 36, thereby causing the second check valve 46 to close. When the timer 58 activates the air control valve 70, the control flap 75 on the second valve port 74 closes and the control flap 77 of the outside air valve port 76 opens so that outside air 97 may enter the secondary recovery tank 36 through the first inlet port 71. When outside air 97 enters the secondary recovery tank 36 and increases the pressure therein to automatically close the first check valve 44, vacuum pressure from the vacuum source 16 is maintained in the primary recovery tank 30. Waste water 92 now collects in the primary recovery tank 30 without disruption of vacuum pressure to the cleaning apparatus 20. When pressure inside the secondary recovery tank 36 eventually reaches atmospheric pressure, the second check valve 46 automatically opens thereby allowing the waste water 92 located inside the secondary recovery tank 36 to be discharged. After the pre-selected period has elapsed, the timer 58 is de-activated so that the flap 75 on the second valve port 74 opens, and the flap 77 on the outside air valve port 76 closes. The flow of outside air 97 into the secondary recovery tank 36 is prevented and air is once again allowed to flow from the secondary recovery tank 36 to the primary recovery tank 30 via the air conduit 64. Any new air that enters the secondary recovery tank 36 is now removed and the first check valve 44 opens and the second check valve 46 closes. By activating and deactivating the timer 58, the first and second inlet ports 71, 74 and outside air valve port 76 are opened and closed, thus providing continuous vacuum pressure to the cleaning apparatus 20.

In another embodiment, a basin 86 is provided that is placed under the secondary recovery tank 36 so that any discharged waste water 92 may be collected therein so that the secondary recovery tank 36 does not have to be positioned over a toilet 90. Attached to the basin 86 is an optional drain hose 87 with an optional pump 88 that enables the waste water 92 to gradually drain or be pumped to a remote location such as a collection tank (not shown) or a sewer line 94. The use of the basin 86 also enables the system 10 to be portable so that the disposal tank 25 may be located away from the toilet 90 or sewer line 94.

In another embodiment, shown in FIG. 5, the timer 58 is replaced with a float valve assembly 83 that controls the activation of the air control valve 70 when the waste water 92 inside the secondary recovery tank 36 reaches a specific level. The float valve assembly 83 includes one stationary contact 84 and one float contact 85 that makes contact with the stationary contact 84 when the level of the waste water 92 inside the secondary recovery tank 36 rises. When contact is made, the second valve port 74 and the outside air valve port 76 on the air control valve 70 close and open, respectively, to control the flow of outside air into the secondary recovery tank 36.

In still another embodiment, a safety float valve 89 is provided over the air outlet port 34 on the primary recovery tank 30 which automatically closes the air outlet port 34 when waste water 92 in the primary recovery tank 30 reaches an undesirable height.

In compliance with the statute, the invention described herein has been described in language more or less specific as to structural features. It should be understood, however, that the invention is not limited to the embodiments described herein or to specific features shown, since the means and construction shown comprise only the preferred embodiments for putting the invention into effect. It is also understood that the phraseology and terminology employed herein are for the purpose of description and should not be regarded as limiting. The invention is therefore claimed in any of its forms or modifications within the legitimate and valid scope of the amended claims, appropriately interpreted in accordance with the doctrine of equivalents.

Further, the purpose of the foregoing abstract is to enable the U.S. Patent and Trademark Office personnel, patent bar practitioners, and the general public, to determine quickly from a cursory inspection the nature and essence of the technical disclosure of the invention disclosed herein. The Abstract is neither intended to define the invention, which is measured by the claim, nor is it intended to be limiting as the scope of the invention in any way.

I claim:

1. A carpet cleaning system, comprising:

a. a vacuum source;

b. a primary recovery tank connected to said vacuum source;

c. a secondary recovery tank located below said primary recovery tank;

d. a first check valve disposed between said primary recovery tank and said secondary recovery tank to control flow of liquid from said primary recovery tank to said secondary recovery tank, said first check valve being closed when the pressure inside said secondary recovery tank is greater than the pressure inside said primary recovery tank;

e. a second check valve attached to said secondary recovery tank to allow a fluid in said secondary recovery tank to exit, said second check valve being oriented to close when said first check valve is open, and to open when said first check valve is closed;

f. an air conduit extending between said primary recovery tank and said secondary recovery tank;

g. an air control valve connected to a section of said air conduit located in said secondary recovery tank, said air control valve including an outside air port that allows outside air to selectively flow into said secondary recovery tank;

h. a control means connected to said air control valve to control flow of air between said first and second recovery tanks and the flow of outside air through said outside air port and into said secondary recovery tank;

i. a clean water source; and, j. a carpet cleaning apparatus that uses water and vacuum pressure to clean a carpet, said carpet cleaning apparatus being connected to said clean water source to deliver clean water thereto and attached to said primary recovery tank to create vacuum pressure.

2. The carpet cleaning system, as recited in claim 1, wherein said control means is a timer connected to said air control valve.

3. The carpet cleaning system, as recited in claim 1, wherein said control means is a float valve assembly located inside said secondary recovery tank.

4. The carpet cleaning system, as recited in claim 1, further including a basin located under said secondary recovery tank to collect discharged waste water therefrom.

* * * * *